United States Patent [19]

Korta

[11] 4,097,187

[45] Jun. 27, 1978

[54] ADJUSTABLE VANE ASSEMBLY FOR A GAS TURBINE

[75] Inventor: John Korta, Stoney Creek, Canada

[73] Assignee: Westinghouse Canada Limited, Hamilton, Canada

[21] Appl. No.: 697,021

[22] Filed: Jun. 17, 1976

[30] Foreign Application Priority Data

Oct. 14, 1975 Canada ..... 237568

[51] Int. Cl.[2] ..... F01B 25/10; F01D 17/16; F01D 9/04

[52] U.S. Cl. ..... 415/161; 415/189; 415/193; 415/218

[58] Field of Search ..... 415/161, 190, 189, 160, 415/193, 191, 200, 218; 60/39.32

[56] References Cited

U.S. PATENT DOCUMENTS

| | | | |
|---|---|---|---|
| 2,279,258 | 4/1942 | Allen et al. | 415/193 |
| 3,945,758 | 3/1976 | Lee | 415/218 UX |
| 3,990,810 | 11/1976 | Amos et al. | 415/161 |

FOREIGN PATENT DOCUMENTS

| | | | |
|---|---|---|---|
| 572,865 | 3/1959 | Canada | 415/190 |
| 805,015 | 11/1958 | United Kingdom | 415/161 |

*Primary Examiner*—Carlton R. Croyle
*Assistant Examiner*—Donald S. Holland
*Attorney, Agent, or Firm*—Robert H. Fox; Edward H. Oldham

[57] ABSTRACT

This invention relates to a vane assembly for a split-shaft gas turbine engine. The invention relates to a vane assembly which is placed in the hot gas stream to control diffusion and to deflect the hot gas just prior to passage through the blades of the power wheel. The vane assembly is characterized by having each controlling and deflecting blade constructed in two cooperating parts, a forward portion of the vane which is hollow and stationary to control diffusion and a trailing portion which is allowed to pivot through a small angle to control deflection. The vane assembly is constructed in sections to have two complete vanes per section and the sections are fitted into circumferential slots in the casing of the turbine. The vane tip actuators are passed through the turbine casing and are fitted to the trailing portions of each vane so that the trailing portions of the entire assembly move as a unit by a single control mechanism.

2 Claims, 4 Drawing Figures

ADJUSTABLE VANE ASSEMBLY FOR A GAS TURBINE

CROSS REFERENCE TO RELATED APPLICATIONS

United States Application Ser. No. 694,926, filed 06/11/76, in the names of John Korta, Arthur W. Upton, John Danko and Azizullah, entitled Cooling Apparatus for a Bearing in a Gas Turbine, now abandoned.

United States Application Ser. No. 694,928, filed 06/17/76, in the name of John Korta, entitled Vane Rotator Assembly for a Gas Turbine, now abandoned.

United States Application Ser. No. 697,060, filed 06/17/76, in the names of John Korta and Walter R. Ward, entitled Cooling Apparatus for Split Shaft Gas Turbine, now U.S. Pat. No. 4,034,558.

BACKGROUND OF THE INVENTION

Gas turbine engines require both stationary and moving blades to efficiently produce power from fuel. If the fuel air mixture were burned and passed through the power blades of the power wheel very little energy could be recovered from the hot gas because of the lack of control over the movement of the hot gas. To overcome this problem, it has been customary to provide at least one set of stationary blades or vanes to control the direction of the moving gas stream and impart a velocity to the hot gas stream which will cause the gas stream to give up a maximum amount of energy upon passage through the blades of the power wheel.

At times when power demands were of a changeable nature, turbine builders have provided a section wherein the entire vane has been privotally adjustable to alter the deflection angle of the hot gas mixture. This method of deflection has been satisfactory but does impose some restrictions on the mechanical construction of the turbine.

It will become evident if the entire vane is rotatable that the supporting sections of the vane assembly in which the vanes pivot must be securely anchored in the turbine casing. This requires some extra considerations and may involve some additional struts in the engine to stabilize the inner vane support which pivotally supports the inner pivot portions of the rotating vanes. No relative circumferential motion of these pivoting supports may be tolerated or binding of the pivot portions of the rotatable vanes may occur. In the turbine of this invention, because of the construction of the vane assembly, it will be seen that the inner and outer support member of the vanes themselves are rigidly held in place because the leading edge portion of the vane (i.e., the stationary portion) is integrally cast with the inner and outer support members of each section. This enables the location of the inner support section to be defined and does simplify construction. The stationary vanes do provide more than the single function of controlling diffusion of the gas stream prior to passage through the movable trailing portion. They also provide mechanical support for the inner section of the rotatable trailing portions, and because the leading edge portions of the stationary vanes are hollow, provision for cooling passages to the inner part of the turbine may be effected in this part of the turbine.

Prior art turbine engines have usually made provision for the insertion of the stationary vane assembly into place, one vane at a time, by providing axial slots in the machine so that the vanes and supporting members may be slid axially in slots to the desired location.

SUMMARY OF THE INVENTION

The vane assembly of this invention is assembled in such a manner that sections of the assembly having two complete vane members are slid around in the casing in circumferential slots. Sections are added in this manner until the assembly is complete. This assembly method is made possible because the turbine casing is manufactured in two halves and the vane sections under consideration are inserted in the split casing halves prior to assembly of the two halves. Each section carries two complete vane members, i.e., two separate stationary leading portions and a pair of pivotally adjustable trailing edge portions. The vane sections are secured in the casing by keying the outer support members of the pivoting vane section into the casing of the turbine, and provision is also made to "hook" the outer support members of the stationary vane section to the casing in a novel manner. Provision is made to move all the trailing edges of the vane members together. This vane structure then provides a stationary vane portion to control diffusion and a movable vane portion to control flow direction.

DESCRIPTION OF THE PREFERRED EMBODIMENT

Figure 1:
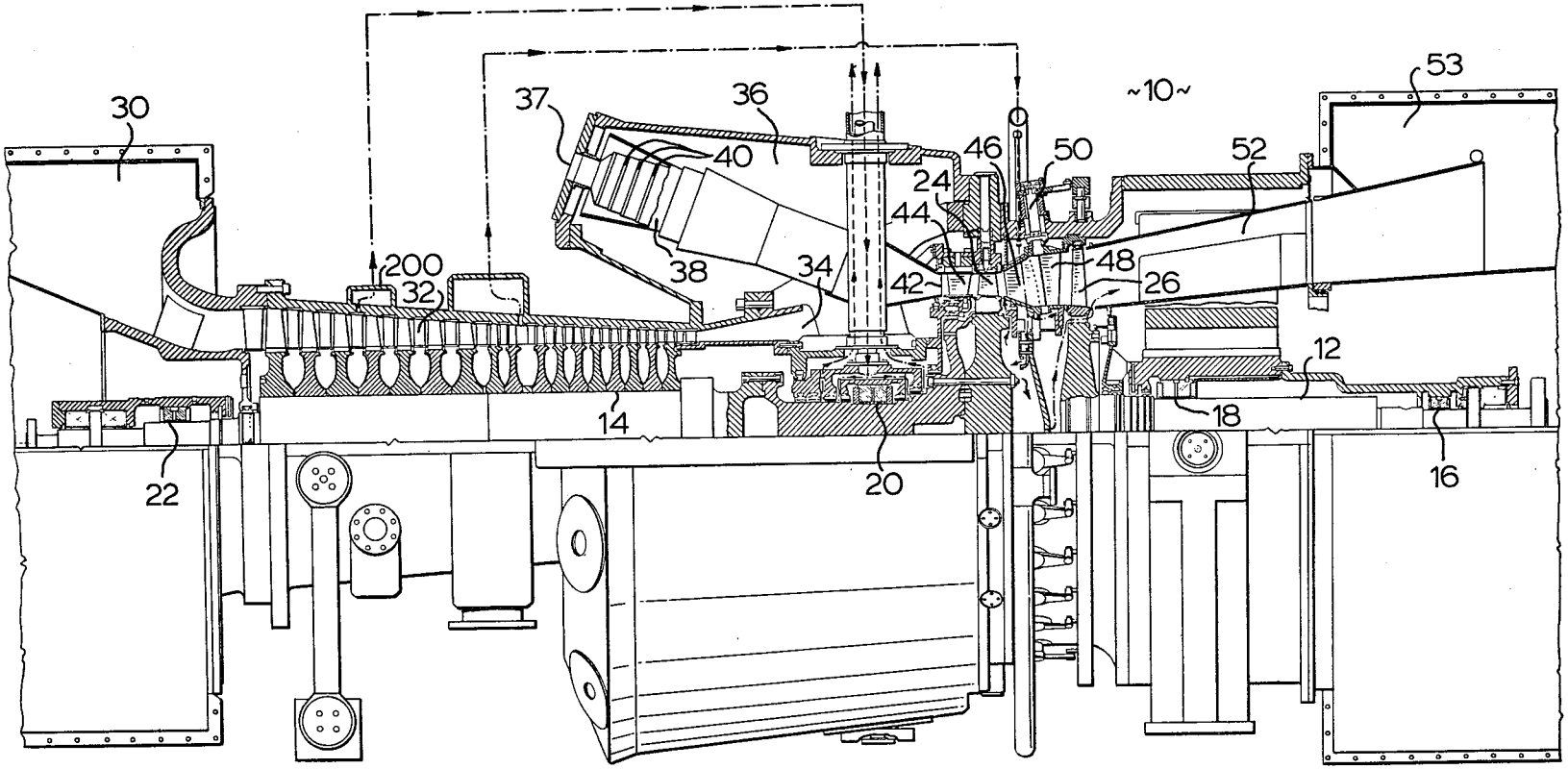
FIG. 1 is a partial sectional view of the gas turbine to which this invention is applied.

Referring now to FIG. 1, it will be seen that a "double shafted" or "split-shaft" turbine 10 is shown, having output power shaft 12 and compressor shaft 14. Power output shaft 12 is journalled in bearings 16 and 18 and compressor shaft 14 is journalled in bearings 20 and 22. Power to drive the compressor section of the compressor turbine is supplied by blades 24. The power blades 26 are provided to drive output shaft 12 to supply power to a load.

As the operation of the complete turbine is fairly obvious to those skilled in the art only a brief description of the overall turbine will be given here.

Air is supplied to intake plenum 30 and is subsequently drawn into the compressor stages 32 and compressed. When the air passes through the last blades of the compressor stage it will have attained a pressure of 90–100 psi. At this time the compressed air is ducted through outlet 34 into the combustor casing 36 of the turbine. Turbine fuel is supplied to fuel inlets 37 of the turbine baskets 38 and the compressed air is passed through passages 40 in baskets 38 where it is mixed with the atomized fuel and is subsequently burned. The hot burning gas passes through the basket outlet 42 and is passed through a set of flow directional vanes 44. The gas then passes through the power blades 24 to drive the compressor section, and the gas exits into another set of stationary vanes 46. It will be seen that a set of movable vanes 48 are shown cooperating with the stationary blades 46. Vanes 48 are provided with activators 50 which allow them to pivot through a small angle to provide changes in the duction of the gas passing therethrough. The redirected hot gas thence passes through blades 26 which drive the output shaft 12 to provide output power from the turbine. The hot exhaust gas thence passes through an exhaust diffuser 52 and then into an exhaust plenum 53 where it may be ducted to atmosphere or passed through a heat exchanger for purposes of regeneration.

As this disclosure is concerned with the construction and operation of the vane members through which the hot gases pass just prior to passage through the blades of the power wheel, it will be convenient to describe the structural details of the gas turbine in this area to familiarize the reader with the environment of this invention.

Figure 2:
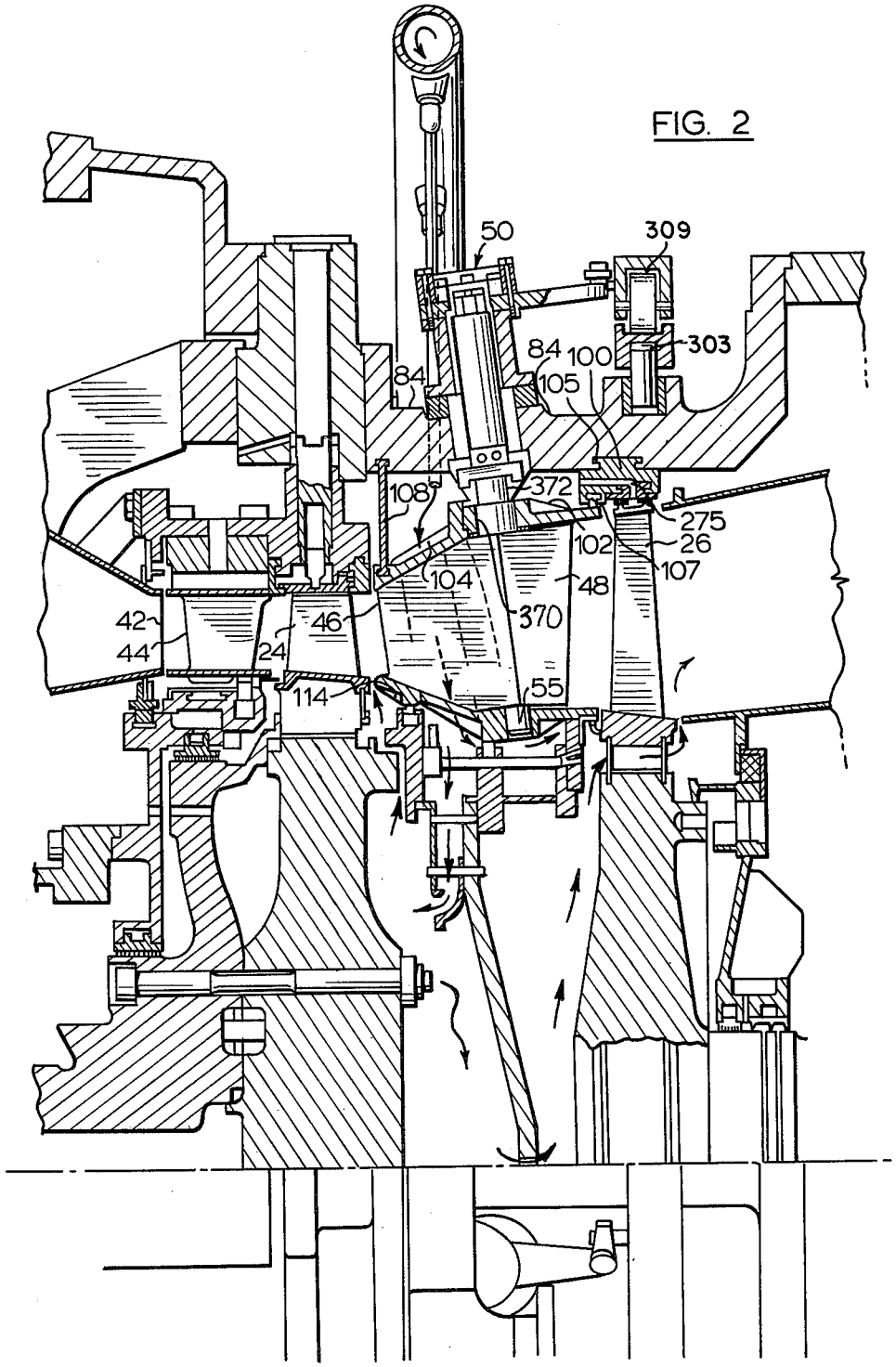
FIG. 2 is a sectional view of the shaft-split section of the turbine.
Figure 3:
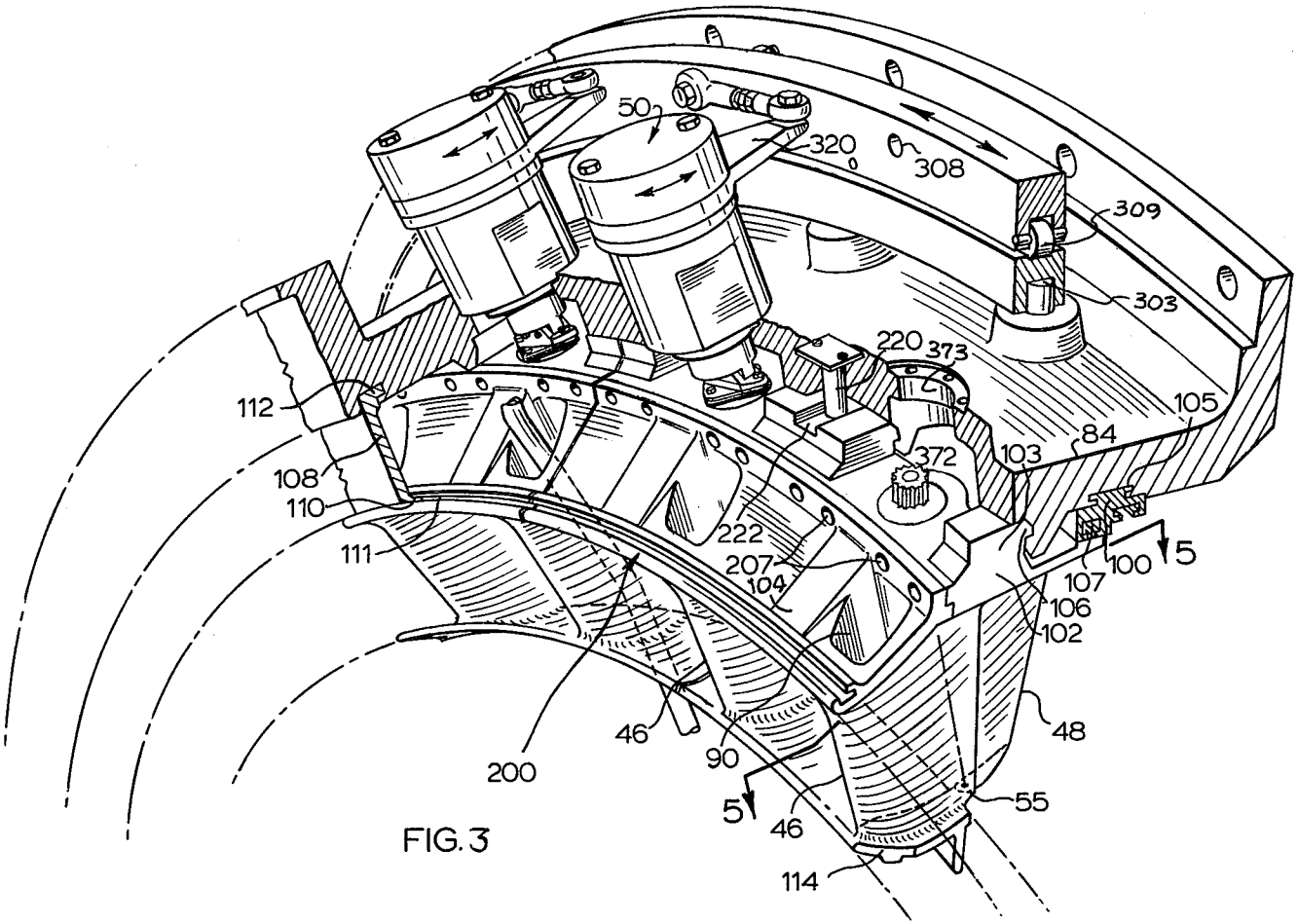
FIG. 3 is a partial perspective showing the vane assembly and actuator mechanism.

FIGS. 2 and 3 best illustrate the construction of the turbine in the area of this invention. Turbine 10 is provided with an outer casing 84 in which a series of arcuate shaped vane assemblies combine to form an annular vane assembly. The annular vane assembly will be composed of an inner shroud in the shape of an annulus and an outer shroud in the shape of a larger annulus being joined together by a set of stationary vanes. One such single vane assembly is shown as 200, wherein the outer section 104 forms part of the outer shroud and the inner section 114 substantially forms one segment of the inner shroud. A pair of stationary hollow vanes are integrally cast with sections 102 and 114 to form a rigid assembly. Vane assembly 200 is also provided with a second outer support member 102 which is also arcuate in shape and is fastened to member 104 by means of bolts 207. Members 102 and 104 when fastened together form one segment of the outer shroud. Member 102 is fastened into the casing 84 by means of a series of projections such as the central projection as 103 and keying is provided by tongue 106 on central projection 103. Of course a circular key groove hereinafter referred to as a first key groove must be provided in the turbine casing 84 to accept the projections 103 and tongues 106 of each vane segment 200. It is this first key groove and projections 106 which serve to lock each vane segment in its axial location in the turbine casing.

Further support for each vane segment 200 is provided by means of member 100 which is keyed into casing 84 at second key groove 105 and into outer section member 102 at 107. Member 100 serves two functions. First it serves as a support and seal between member 102 and casing 84 and it also is provided with air ducts to deliver cooling air to various turbine parts (see duct 275 in FIG. 2, although not pertinent to this application). The upstream side of vane segment 200 is also supported by support and seal member 108. Member 108 is keyed into key slot 111 of outer member 104 by key 110 of member 108. Similarly a third key groove in casing 84 accommodates the key portion 112 at the remote side of member 108. When member 102 is firmly located in the casing 84 member 104 which is bolted thereto to effectively form one complete assembly, is also firmly fixed in location too. Inner section member 114 is permanently located as well.

Figure 4:
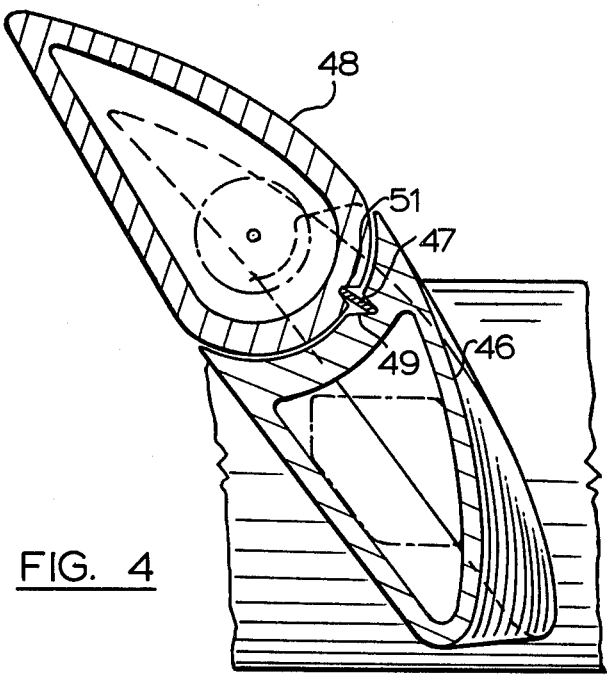
FIG. 4 is a top view of a section of a single vane member.

Vane segments 200 are assembled completely before being inserted in the casing 84. The assembly of the unit is as follows: Two of the pivoting trailing vane tip members 48 are fitted into the inner bearings provided in inner section members 114. It is noted that each movable vane 48 is provided with integral shaft members 55 and 370 at inner and outer ends respectively which are axially aligned and form an axis of rotation for the trailing vanes 48. Shaft members 55 are fitted in the two bearings provided in inner section 114 at the downstream side of member 46; (see FIG. 3). The outer shaft members 370 of the trailing vanes 48 are next inserted into the two bearings provided in outer section members 102 which as yet are unattached to upstream outer members 104. When the members 102 have been fitted over the shaft members 370 it will then be possible to insert bolts 207 into their respective holes to bolt outer section 104 to section 102 to complete the assembly of the arcuate segment 200. Splined shaft ends 372 of trailing vane members 48 protrude through member 102 in order to provide for subsequent attachement of the actuators for rotating the trailing vane members through their operating range. Also a gas seal 47 is also inserted into slots 49 and 51 of the two vanes of assembly 200 during the assembly, (see FIG. 4). At this stage only the splined portion 372 of the pivoting trailing portion of the adjustable vane 48 will protrude above the outer bearing in member 102.

The completed arcuate shaped assembly 200 of two vanes will be fitted into the first key groove provided in casing 84 and slid around in the casing 84 of the turbine to the desired permanent location. Adjacent similar segments of vanes are likewise slid around the casing in the grooves provided until the complete vane structure is complete. Adjacent sections of vane assemblies 200 do not fit tightly together, but a small space is left between each of the sections 200 which is sealed by a gas seal (a thin metal strip, not shown, placed in a pair of "U" shaped abutting channels in adjacent sections). This allows for expansion of turbine components during thermal cycling.

After the vane segments 200 are in place in the desired location in the casing 84, pin 220 is bolted into place in casing 84 to engage slot 222 and hold the vane assembly securely in place against any movement around inside the casing in the groove provided. Thence member 100 is slid around the casing 84 in second key groove 105 until engagement with projection 107 of outer section 102 is made. Similarly member 108 is slid around in the third key groove in casing 84 with key portion 112 engaging the third key groove in the casing 84 until key slot 111 is engaged. At this time the insertion of the members 100 and 108 into the various slots and key grooves holds the various vane segments firmly in place.

It will be noted that the axis of rotation of the movable vanes 48 passes through the center of spline portions 372, and also through the center of access openings 373 provided in casing 84 for the pivot actuators 50. Also the axis of rotation of the rotatable trailing vanes 48 passes through the first key groove in casing 84.

It is now possible to fit the pivoting actuators 50 over the splined portions 372 of the rotatable trailing vanes 48 and complete the assembly of the adjustable vane mechanism of the turbine.

The vane segments 200 comprises two complete vanes with rotatable trailing tips and is a convenient device for assembly purposes. The complete assembly of vanes provides for both control of diffusion and deflection of the hot gas stream. Stabilization of the inner section member 114 is achieved by the inherent construction of the vane segment 200 thus the overall construction is simplified.

The key groove provided in casing 84 for projections 103 also provides room for the spline portions 372 of the adjustable vane to travel during assembly. Members 100 and 108 are convenient to install and provide excellent stabilization of the complete vane segment 200.

Because the axis of rotation of the trailing vanes 48 passes through the third key groove in casing 84 and the central projection 103 serves to effectively lock segment 200 in place in casing 84, any misalignment of the pivot actuators 50 due to thermal expansion of casing 84 or segment 200 tends to be eliminated. Any relative motion of the vane segment 200 which would lead to misalignment of the trailing vane portions 48 and pivot actuators 50 tends to be eliminated by this construction.

The embodiments of the invention in which an exclusive property or privilege is claimed are defined as follows:

1. A vane assembly for a gas turbine engine the casing of which engine is provided with at least three spaced circumferential key grooves on the interior surface thereof to receive and anchor said vane assembly in place, said vane assembly being of arcuate shape and having inner and outer shroud sections being coupled together by a pair of stationary vanes to form an integral unit, a pair of rotatable vane members, each having an integral shaft means formed therein to provide a suitable axis of rotation for each vane, said inner and outer shroud sections being provided with suitable bearing means to receive said shaft means of said rotatable vanes, said rotatable vanes being mounted in nesting relationship with said stationary vanes in the bearings provided in said inner and outer shroud sections, a central projection means formed on said outer shroud section acts as a first locking member by keying said vane assembly into a first key groove on the interior of said casing, second and third arcuate locking members being keyed into second and third key grooves in the interior of said turbine casing, said second and third members also being keyed into a pair of key slots provided in said outer shroud, said key slots provided in said outer shroud being on opposite sides of and spaced apart from said central projection means, said vane assembly being located in said turbine casing such that the axis of rotation of each rotatable vane extends in a radial direction and passes through said first key groove.

2. A vane assembly as claimed in claim 1 wherein the integral shaft means of each rotatable vane includes a protrusion, said protrusion being in the form of a spline projecting slightly outwardly beyond said outer shroud section, said turbine casing having access openings provided in the casing thereof in alignment with the axis of rotation of said rotatable vanes for the attachment of driving means to said spline.

* * * * *